US005080728A

United States Patent [19]

Hasenclever

[11] Patent Number: 5,080,728

[45] Date of Patent: Jan. 14, 1992

[54] ROLLED ALUMINUM PRODUCT AND METHOD FOR ITS PRODUCTION

[75] Inventor: Jochen Hasenclever, Bonn, Fed. Rep. of Germany

[73] Assignee: Vereinigte Aluminium-Werke Aktiengellschaft, Bonn, Fed. Rep. of Germany

[21] Appl. No.: 513,249

[22] Filed: Apr. 23, 1990

[30] Foreign Application Priority Data

Apr. 28, 1989 [DE] Fed. Rep. of Germany ..... 3914020

[51] Int. Cl.[5] ..... C21D 8/02; C22C 21/00

[52] U.S. Cl. ..... 148/11.5 A; 148/2; 148/437; 148/439; 420/535; 420/550

[58] Field of Search ..... 420/535, 537, 538, 553, 420/544, 550, 547; 148/415, 417, 437, 439, 2, 11.5 A

[56] References Cited

U.S. PATENT DOCUMENTS 4,737,198 4/1988 Shabel et al. ..... 148/437

FOREIGN PATENT DOCUMENTS 224874 7/1985 German Democratic Rep. ..... 420/550

57-120648 7/1982 Japan ..... 148/439

59-85837 5/1984 Japan ..... 420/535

*Primary Examiner*—R. Dean
*Assistant Examiner*—Robert R. Koehler
*Attorney, Agent, or Firm*—Darby & Darby

[57] ABSTRACT

Production of a thin aluminum alloy strip containing iron, manganese and silicon by hot rolling and cold rolling with a subsequent final annealing, includes the steps of (a) producing a bar by a continuous casting process, from 0.7-1.15% by weight Fe; 0.5-2.0% by weight Mn; and less than 0.6% by weight Si; as well as impurities, none of which exceeds 0.03% by weight, the remainder of the bar being aluminum; (b) homogenizing the bar for 2 to 20 hours at a temperature from 620° to 480° C., after which the bar is (c) hot rolled in a usual manner to a final thickness of 4 mm; then (d) cold rolled without intermediate annealing to a final thickness of 40 to 250 microns; and (e) annealing the cold-rolled strip for 1 to 6 hours at a temperature of 250° to 400° C. The alloy produced has a sub-grain structure, with an average 10 grain diameter of 0.5 to 5 microns, the subgrains constituting at least 50% of the total structure. An alternative embodiment includes the addition of at least one of the following elements: Mg: 0.1-0.8% by weight, Cu: 0.1-0.3% by weight, and Zr: 0.01-0.20% by weight.

3 Claims, 1 Drawing Sheet

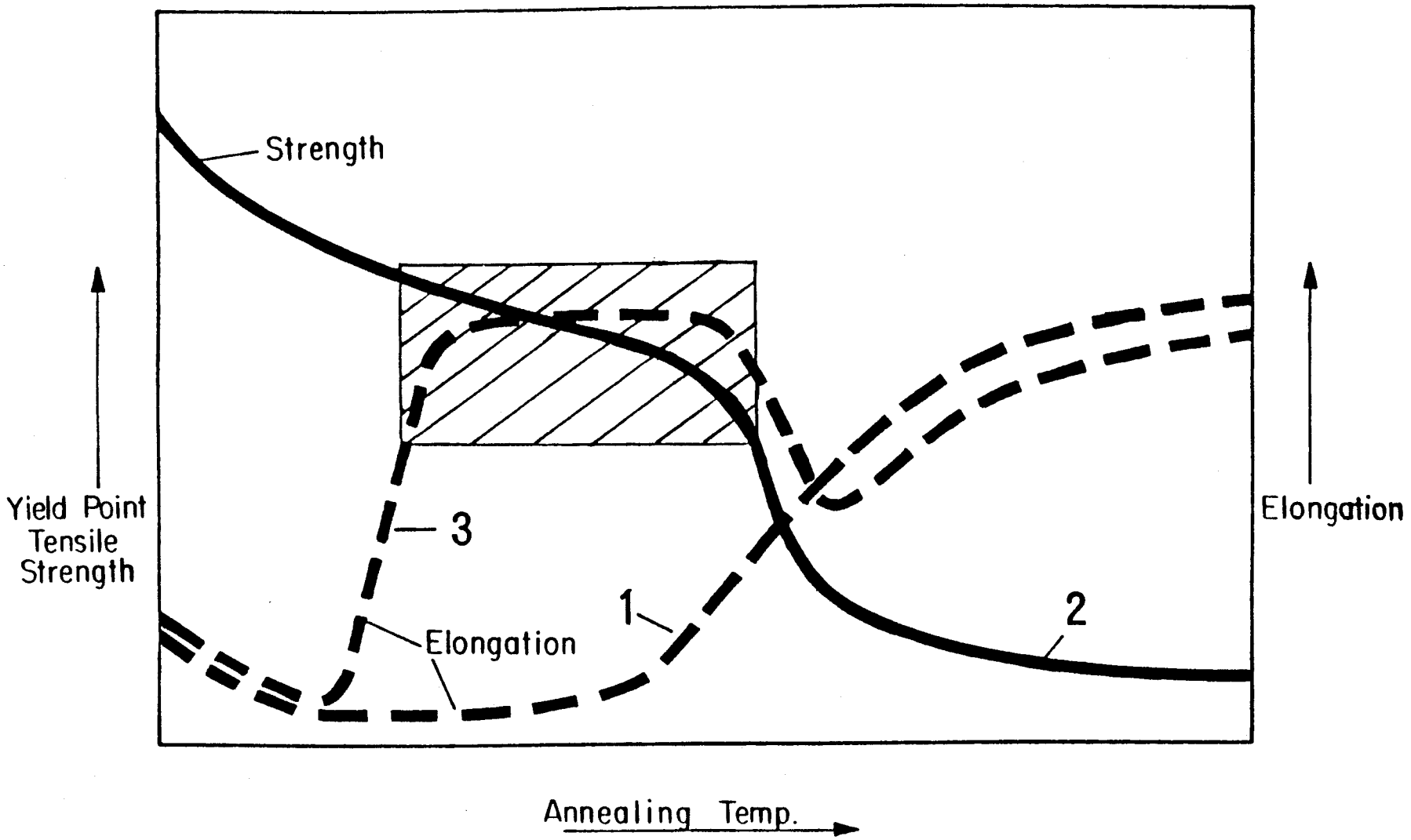
Elongation
Yield Point
Tensile
Strength
Strength
Elongation
1
2
3
Annealing Temp.

ROLLED ALUMINUM PRODUCT AND METHOD FOR ITS PRODUCTION

FIELD OF THE INVENTION

The invention relates to a thin aluminum alloy strip, which contains iron, manganese and silicon as well as to a method for its production. The inventive strip has high strength values and high elongation values and finds application in packaging and refrigerator construction.

BACKGROUND OF THE INVENTION

Aluminum alloys containing iron, manganese and silicon are known. For example, German Patent 24 23 597 (Alcan) discloses a method for the production of dispersion hardened aluminum alloy sheets and foils. The product comprises an aluminum alloy with 1.65% iron, 0.95% manganese, 0.09% silicon and other impurities up to 0.01%. It has a tensile strength of 175 N/mm$^2$, a 0.2% yield point of 168 N/mm$^2$, and an elongation of 15% after being annealed at 300 C. (see, Table 2, No. 1). In this method, however, it is necessary that a cast block be produced with 5.0 to 20% by volume of unaligned, rod shaped intermetallic phases with an average diameter of 0.1 to 1.5 microns. During subsequent reduction in cross section, the intermetallic phases must be broken up into very fine particles.

U.S. Pat. No. 4,483,719 (Schweizerische Aluminium AG) (German Patent 33 30 814) discloses another method for the production of rolled aluminum products with iron, manganese and silicon as alloying elements. After being rolled down at least 60% and annealed at a temperature of at least 250 C., these products have a grain size of less than 10 microns. The strength values obtained with this method are approximately 125 MPa for tensile strength, 80 MPa for the 0.2% yield point and 20% for elongation (Example 4).

INCORPORATION BY REFERENCE

The complete disclosure of each of the prior art patent documents discussed above, namely U.S. Pat. No. 4,483,719, and German Patents 24 23 597 and 33 30 814, is incorporated herein by reference.

SUMMARY OF THE INVENTION

It is an object of the present invention to produce a thin aluminum strip from an AlFeMn alloy, which has a high elongation value, good strength properties and at the same time can be produced in a simple manner.

Pursuant to the invention, this object is achieved by an aluminum alloy, containing 0.7–1.15% by weight iron, 0.5–2.0% by weight manganese and less than 0.6% by weight silicon, the remainder of the composition being aluminum, as well as impurities, none of which exceeds 0.03% by weight.

The inventive alloy has a sub-grain structure, with an average 10 grain diameter of 0.5 to 5 microns, the subgrains constituting at least 50% of the total structure.

It has been discovered that, by adhering to the above mentioned alloying limits for iron, manganese, silicon and impurities in conjunction with a special homogenization and rolling procedure with subsequent final annealing, a surprisingly advantageous combination of strength and elongation properties can be achieved.

In accordance with the invention, a bar is produced by a continuous casting process. The bar is homogenized for 2 to 20 hours at a temperature of from 620 to 480 C., resulting in roundish intermetallic phases being finely dispersed and a rod shaped intermetallic phases content of less than 5% by volume. The bar is then hot rolled to a thickness of 4 mm, cold rolled without intermediate annealing to a thickness of 40 to 250 microns, and finally annealed for 1 to 6 hours at a temperature of 250 to 400 C.

During the final annealing, the thermally activated rearrangement of displacements, which have arisen during the preceding deformation, is into arrangements of lower energy, mainly small angle grain boundaries, which form the boundaries of subgrains.

The properties of the inventive rolled product can be applied advantageously in the packaging industry, for example, for plate strips or also in refrigerator construction for fin stock, and for similar purposes.

It has also been discovered that the strength of the inventive alloy can be increased even further by including at least one of following alloying elements: Mg: 0.1–0.8% by weight, Cu: 0.1–0.3% by weight, and Zr: 0.01–0.20% by weight.

BRIEF DESCRIPTION OF THE DRAWING

With these and other objects in view, which will become apparent in the following detailed description, the present invention, which is shown by example only, will be clearly understood in connection with the accompanying drawing, in which the single figure diagrammatically shows the re-annealing behavior of the mechanical properties of the invention.

DESCRIPTION OF THE PREFERRED EMBODIMENTS

The invention is explained in greater detail by means of several examples of the method. The re-annealing behavior of the mechanical properties of the invention is shown diagrammatically in the drawing.

EXAMPLE 1

A continuous casting bar of
Si = 0.12% by weight
Fe = 1.0% by weight
Mn = 1.0% by weight
other elements = 0.02 % by weight
the remainder being aluminum
was cast in a 100×300×500 mm format and homogenized for 7 hours at a temperature of 550 C. After that, the proportion by volume of rod shaped intermetallic phases was below 5%.

Hot rolling was carried out in the usual manner to a 4 mm thick hot strip, whereupon cold rolling was carried out to a 0.1 mm strip without intermediate annealing. The following strength values were measured in the rolling direction (see DIN 50145):
$R_m = 164$ N/mm$^2$
$R_{p0.2} = 146$ N/mm$^2$
$A_{25} = 15\%$

EXAMPLE 2

A continuous casting bar of the same composition as in Example 1 was homogenized for 15 hours at a temperature of 610 C. and subsequently rolled hot and cold as in Example 1. The final annealing was carried out for one hour at a temperature of 310 C. and resulted in the following strength values:
$R_m = 150$ N/mm$^2$
$R_{p0.2} = 120$ N/mm$^2$
$A_{25} = 22.5\%$

EXAMPLE 3

A continuous casting bar of the following composition was prepared:

Si=0.12% by weight
Fe=1.0% by weight
Mn=0.6% by weight
other elements=0.02% by weight
the remainder being aluminum The continuous casting bar was homogenized for 7 hours at a temperature of 550 C. This treatment resulted in a structure which had less than 3% by volume of rod shaped intermetallic phases. After the above-mentioned rolling procedure was carried out, the material was annealed at 350 C. for 1 hour and then had the following strength values:

$R_m$=132 N/mm$^2$
$R_{p0.2}$=92 N/mm$^2$
$A_{25}$=24%.

EXAMPLE 4

A continuous casting bar of 0.12% by weight silicon, 1.0% by weight iron, 1.0% by weight manganese, 0.5% by weight magnesium and less than 0.02% by weight of other elements, the rest being aluminum, was homogenized for 7 hours at a temperature of 550 C. After that, the structure had less than 2% by volume of rod shaped intermetallic phases. After carrying out the rolling procedure described in Example 1, the material was annealed for 1 hour at 260 C.; it then had the following properties:

$R_m$=188 N/mm$^2$
$R_{p0.2}$=177 N/mm$^2$
$A_{25}$=14%.

Results

The behavior of the mechanical properties of the inventive product upon re-annealing is shown diagrammatically in FIG. 1. The strength values are plotted as a function of the annealing temperature. Curve 1 shows the course of the elongation and curve 2 shows the course of the yield point or the tensile strength after a conventional manufacturing process (see, for example, FIG. 1 of the Alcan German Patent 24 23 597 and the corresponding strength values according to DIN 1788, Feb. 1983 edition).

Curve 3 shows the course of the elongation of a semi-finished aluminum product manufactured according to the present invention. Curve 2 also shows the course of the yield point or the tensile strength for the invention. It can be seen that, within a very wide annealing range corresponding to a temperature difference of 10 to 50 C., the strength (curve 2) as well as the elongation (curve 3) lie at a very high level for the inventive product. The inventive region is indicated in the cross-hatched field.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A thin aluminum alloy, strip containing iron, manganese and silicon, comprising the following alloying composition:

Fe: 0.7–1.15% by weight
Mn: 0.5–2.0% by weight
Si: <0.6% by weight the remainder of the composition being aluminum, as well as impurities, no one of said impurities exceeding 0.03% by weight;

said alloy strip having a sub-grain structure with an average grain diameter of 0.5 to 5 microns, the subgrains constituting at least 50% of the total structure.

2. The alloy as claimed in claim 1, further comprising additionally at least one alloying element selected from the group consisting of:

Mg: 0.1–0.8% by weight,
Cu: 0.1–0.3% by weight, and
Zr: 0.01–0.20% by weight.

3. Method for the production of a thin aluminum alloy strip containing iron, manganese and silicon by hot rolling and cold rolling with a subsequent final annealing, comprising the steps of producing a bar by a continuous casting process, from Fe: 0.7–1.15% by weight,
Mn: 0.5–2.0% by weight,
Si: ≦0.6% by weight as well as impurities, no one of said impurities exceeding 0.03% by weight, the remainder of the bar being aluminum;

said alloy having a sub-grain structure with an average grain diameter of 0.5 to 5 microns, the subgrains constituting at least 50% of the total structure;

homogenizing the bar for 2 to 20 hours at a temperature from 620° to 480° C., after which the bar has roundish intermetallic phases finely dispersed and a rod-shaped intermetallic phase content of less than 5% by volume;

hot-rolling the bar to a final thickness of 4 mm;

cold-rolling the bar without intermediate annealing to a cold-rolled strip having a thickness of 40 to 250 microns; and annealing the cold-rolled strip for 1 to 6 hours at a temperature of 250° to 400° C.

* * * * *